US009243838B1

(12) United States Patent
Kim

(10) Patent No.: US 9,243,838 B1
(45) Date of Patent: Jan. 26, 2016

(54) DRAWER IN REFRIGERATOR WITH A CONVERTIBLE FLEXIBLE COVER

(71) Applicant: Dongbu Daewoo Electronics Corporation, Seoul (KR)

(72) Inventor: Bong Jun Kim, Incheon (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 0 days.

(21) Appl. No.: 14/571,069

(22) Filed: Dec. 15, 2014

(30) Foreign Application Priority Data

Oct. 6, 2014 (KR) ..... 10-2014-0134326

(51) Int. Cl.
*F25D 23/00* (2006.01)
*F25D 25/00* (2006.01)
*F25D 23/06* (2006.01)

(52) U.S. Cl.
CPC ..... *F25D 25/00* (2013.01); *F25D 23/00* (2013.01); *F25D 23/062* (2013.01); *F25D 2325/00* (2013.01)

(58) Field of Classification Search
CPC ..... F25D 25/005; F25D 11/00; F25D 25/025; A47B 88/20; A47B 2088/0922; A47B 2088/026
USPC ..... 312/402, 404, 330.1, 291, 304, 310, 312/184, 348.3
See application file for complete search history.

(56) References Cited

U.S. PATENT DOCUMENTS

| | | | | |
|---|---|---|---|---|
| 1,160,322 | A * | 11/1915 | Richards | 312/304 |
| 4,527,694 | A * | 7/1985 | Bolt et al. | 211/46 |
| 5,238,139 | A * | 8/1993 | Bisceglia | 220/495.09 |
| 5,803,563 | A * | 9/1998 | Woodward | 312/297 |
| 6,880,902 | B2 * | 4/2005 | Zimmerman | 312/404 |
| 2003/0052583 | A1 * | 3/2003 | Son | 312/404 |
| 2005/0122017 | A1 * | 6/2005 | Son | 312/404 |
| 2005/0205650 | A1 * | 9/2005 | Founds | 229/67.2 |
| 2005/0223953 | A1 * | 10/2005 | Laby | 108/180 |
| 2015/0102717 | A1 * | 4/2015 | Furr et al. | 312/404 |

FOREIGN PATENT DOCUMENTS

| | | | |
|---|---|---|---|
| KR | 1020010052136 | A | 6/2004 |
| KR | 1020040048774 | A | 6/2004 |
| KR | 1020040057883 | A | 7/2004 |

* cited by examiner

*Primary Examiner* — Janet M Wilkens

(57) ABSTRACT

A refrigerator including a drawer capable of storing soft food items and hard food items in separate spaces. The drawer includes a flexible cover that can be detachably positioned by positioning grooves formed on the top of side walls of the drawer. When in a first position, the flexible cover forms a holder that can be used to hold soft food. When in a second position, the flexible cover is used to cover the open top of the drawer and thereby can preserve freshness of food stored under the flexible cover within the drawer.

2 Claims, 9 Drawing Sheets

DRAWER IN REFRIGERATOR WITH A CONVERTIBLE FLEXIBLE COVER

CROSS-REFERENCE TO RELATED APPLICATIONS

This application claims benefit and priority to Korean Patent Application No. 10-2014-0134326, filed on Oct. 6, 2014, with the Korean Intellectual Property Office, the disclosure of which is incorporated herein in its entirety by reference.

TECHNICAL FIELD

The present disclosure relates to a refrigerator, and, more particularly, to storage compartment configurations of a refrigerator.

BACKGROUND

In general, food may be stored in a drawer assembly of a refrigerator. When food is stored in a drawer assembly, e.g., a drawer in a refrigerator, food with soft or deformable textures (or soft food) usually needs to be stored in a separate place from hard food to be protected from unwanted external pressures that tend to break or deform the soft food. For example, users have to pack soft food items in a separate container or a plastic bag and then store them in the drawer assembly, which can be time consuming, inconvenient and wasteful of packing materials.

Further, when soft vegetables and the like are separately packed and stored in a plastic bag or a container, it may be difficult to keep these food items fresh.

SUMMARY

It would be advantageous to provide a storage compartment in a refrigerator capable of effectively protecting soft food items as well as preserving food freshness.

In one embodiment of the present disclosure, a refrigerator includes a cooling system and a drawer assembly. The drawer assembly includes: a drawer main body including a compartment with a top open side; a plurality of positioning grooves formed on the top of the side walls of the drawer main body; and a flexible cover supported by one or more positioning grooves. The flexible cover can convert between a first position and a second position depending on the positioning grooves selected for coupling to the flexible cover. In the first position, the flexible cover can be used as a storage holder, for example, for storing soft food items. In the second position, the flexible cover can be used as a top cover of the drawer main boy and preserve freshness of food items stored therein.

The flexible cover may include: a first rigid member supported by the drawer main body; a second rigid member selectively inserted into one or more positioning grooves; and a cover member configured to connect the first rigid member and the second rigid member. The cover member is formed of a flexible material.

The drawer assembly may further include an auxiliary cover configured to be supported by a positioning groove different from the positioning groove used to support the second rigid member. The auxiliary cover can encompass a space between an open side of the compartment and the second rigid member.

The auxiliary cover may be insertably and extractably disposed in a segment of the compartment. The auxiliary cover may include: a first auxiliary rigid member inserted into the positioning groove different from the positioning groove used to position the second rigid member; a second auxiliary rigid member accommodated in the compartment segment; and an auxiliary cover member coupled to the first auxiliary rigid member and the second auxiliary rigid member, and formed of a flexible material. The second auxiliary rigid member may be heavier than the first auxiliary rigid member.

According to embodiments of the present disclosure, the drawer assembly and the refrigerator including the same can safely store soft food items as well as prolong freshness of food.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
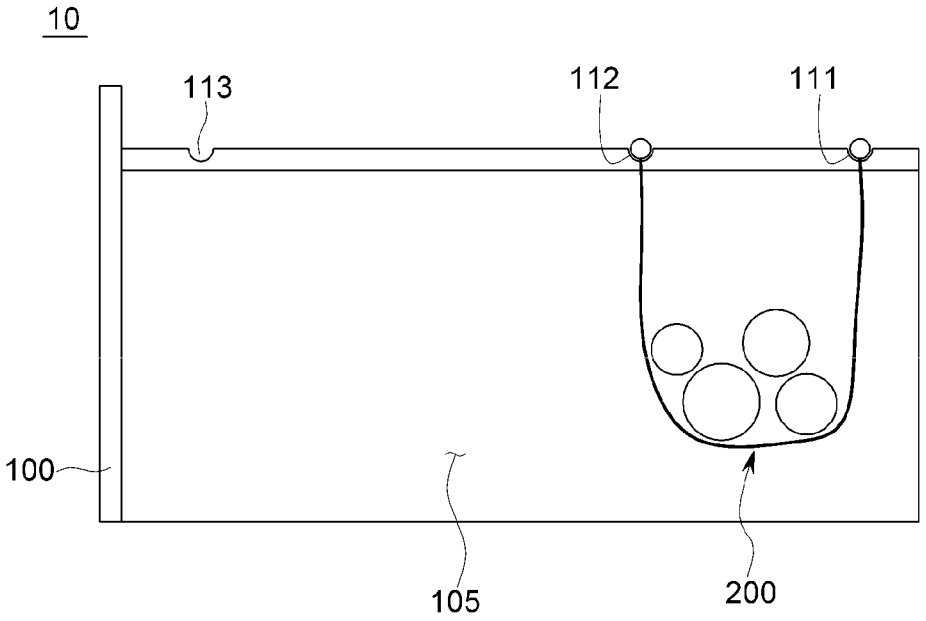
FIGS. 1 and 2 are diagrams illustrating configurations of an exemplary drawer assembly including a cover unit according to an embodiment of the present disclosure.

Hereinafter, the exemplary embodiments of the present disclosure will be described in detail with reference to the accompanying drawings so as for those skilled in the art to easily carry out the present disclosure. The present disclosure may be implemented in various different ways, and is not limited to the exemplary embodiments described herein.

In several exemplary embodiments, constituent elements having the same configuration will be representatively described using the same reference numerals in a first exemplary embodiment, and a second exemplary embodiment will be described regarding only constituent elements that are different from the constituent elements described in the first exemplary embodiment.

The drawings are schematically illustrated, and the scales of the drawings are not identical to each other. Relative dimensions and ratios of the parts illustrated in the drawings are exaggerated or reduced in terms of sizes thereof for clarification of the drawings and convenience, and any dimension is only illustrative, and is not limited thereto. The same structures, elements, or components illustrated in two or more drawings are designated by the same reference numerals so as to illustrate similar features.

The exemplary embodiment of the present disclosure is specifically presented as ideal exemplary embodiments of the present disclosure. As a result, various modifications of the drawings are expected. Therefore, the exemplary embodiments are not limited to specific forms in regions illustrated in the drawings, and for example, include modifications of forms by the manufacture.

Hereinafter, an exemplary drawer assembly according to a first embodiment of the present disclosure will be described with reference to FIGS. 1 to 6.

As illustrated in FIG. 1, the drawer assembly 10 includes a drawer main body 100 having a compartment 105, a plurality of positioning grooves 111-113, and a cover unit 200.

The compartment 105 is open on the top allowing placement of food or other objects in the compartment 105 or removal therefrom. Particularly, the drawer main body 100 may be substantially in a box-like shape.

A plurality of positioning grooves 111-113 are formed on the top of the compartment 105 and used for supporting the cover unit 200 in various positions. The plurality of positioning grooves 111-113 may be formed on the top of two opposite side walls of the drawer main body 100, each side having the same number of positioning grooves. That is, the positioning grooves 111-113 are arranged in pairs on the drawer main body 100. In this example, each positioning groove has a cross-section resembling a U-shape.

Depending on the positioning grooves used for positioning the cover unit 200, the cover unit can be used to divide the compartment 105 or selectively cover the open side of the compartment 105 in part or in whole. In the position illustrated in FIG. 1, or a sagged position, the cover unit 200 is detachably coupled to the plurality of positioning grooves 111 and 112 and forms a holder under the weight of the cover unit 200. In this case, the cover unit 200 can be used to hold and store soft food (shown as circles in FIG. 1) while the rest of the compartment 105 can be used to store hard food or hard containers, etc.

For example, a user may store relatively soft fruit (e.g., grapes) on the cover unit 200, and store hard vegetables (e.g., potatoes) under the cover unit 200 in the compartment 105.

Figure 2:
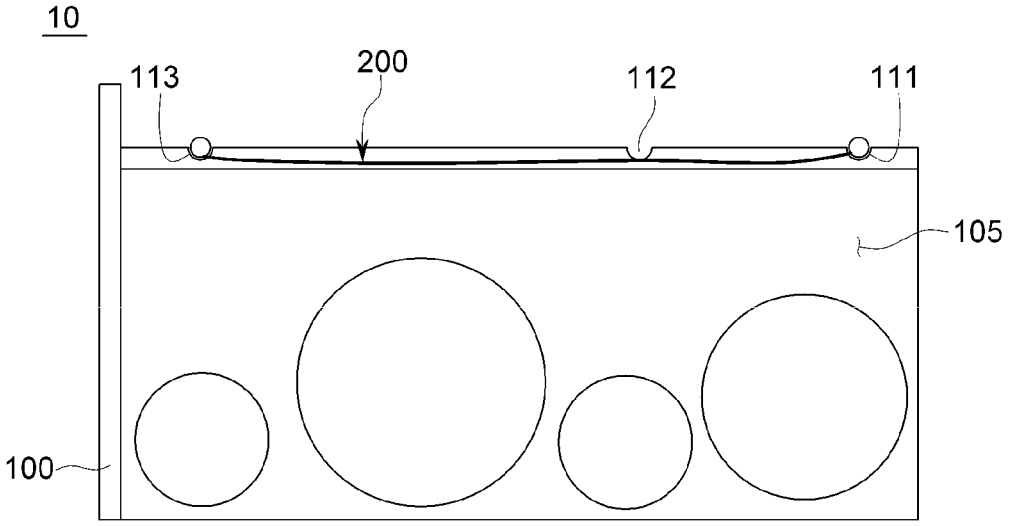

In the position illustrated in FIG. 2, or an extended position, the cover unit 200 is supported by selected positioning grooves such that it forms a top cover for the compartment 105. In this case, the cover unit 200 can retain moisture in the food stored under the cover unit 200 in the compartment 105, thereby effectively preserving freshness of the food.

Figure 3:
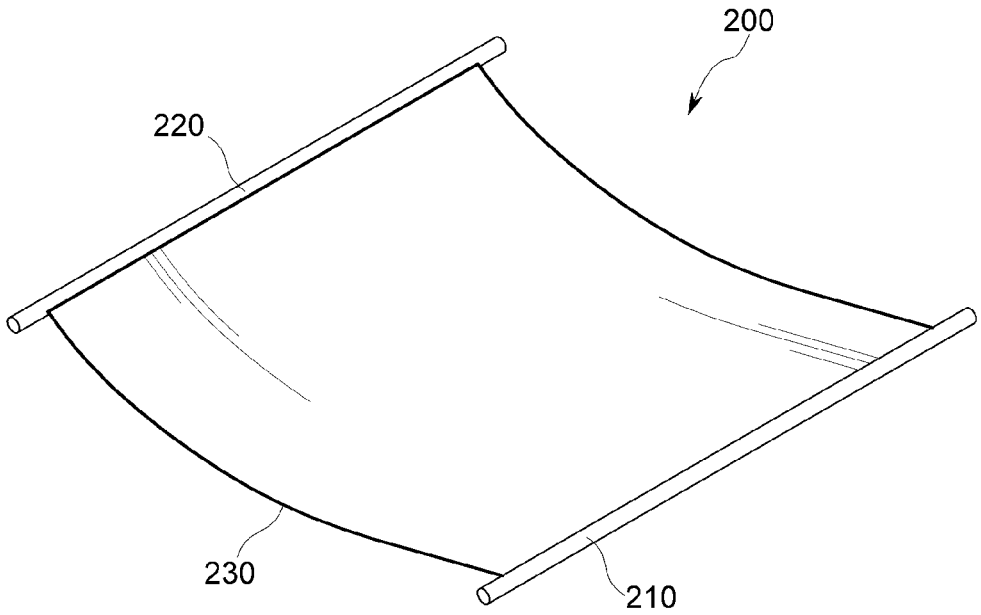
FIG. 3 is a diagram illustrating the configuration of an exemplary cover unit.

As illustrated in FIG. 3, an exemplary cover unit 200 of the drawer assembly 10 according to the first embodiment of the present disclosure may include a first rigid member 210, a second rigid member 220, and a flexible sheet member 230.

The first rigid member 210 may be supported by the drawer main body 100. Particularly, the first rigid member 210 is longer than the width of the top side of the compartment 105 so it can be placed onto (e.g., inserted into) and retained in position by the plurality of positioning grooves 111-113. It will be appreciated that the first rigid member 210 may be coupled to and supported by the walls of the drawer main body 100 in any other suitable means.

The first rigid member 210 may have a bar shape, so that both ends of the first rigid member 210 fit inside the positioning grooves, e.g., 111-113, and thereby held in place on the walls of the drawer main body.

The second rigid member 220 can also be placed onto (e.g., inserted into) and retained in position by the positioning grooves e.g., 111-113. The second rigid member 220 may have the same shape as the first rigid member 210. The second rigid member 220 may be coupled to different positioning grooves than the first rigid member 210.

The sheet member 230 may in one embodiment be made of a flexible material and adhere to the first rigid member 210 and the second rigid member 220. In one embodiment, the sheet member 230 in an extended state is large enough to cover the entire open side of the compartment 105, as shown in FIG. 2. For example, the sheet member 230 may be formed of an antibacterial flexible material. Since the sheet member 230 is formed of flexible material, it can advantageously store food having various shapes when used as a storage holder in a sagged "U"-shaped position.

Figure 4:
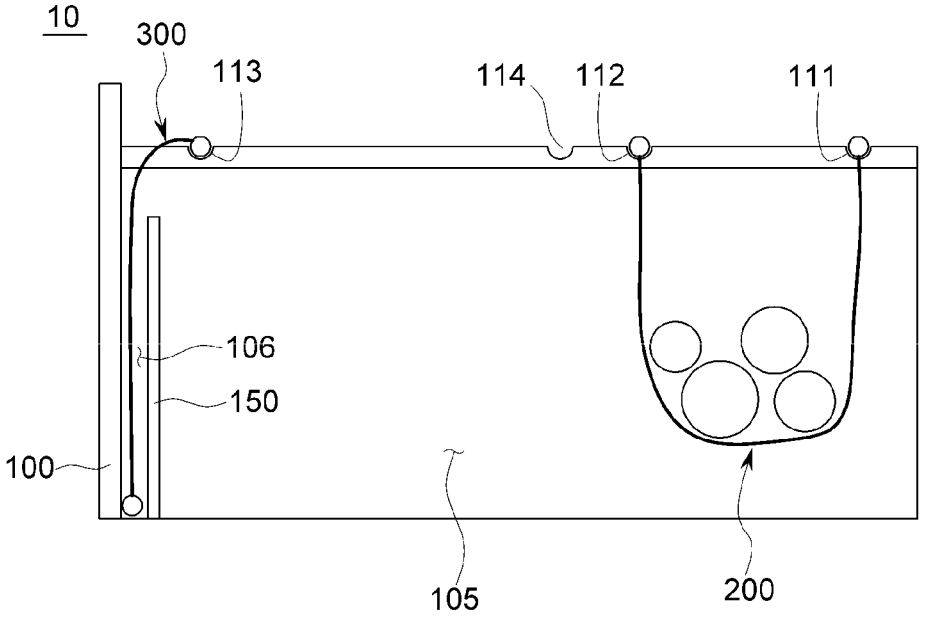
FIGS. 4 and 5 are diagrams illustrating the configuration of an exemplary drawer assembly including an auxiliary cover unit.

As illustrated in FIG. 4, the exemplary drawer assembly 10 according to the first embodiment of the present disclosure may further include an auxiliary cover unit 300.

The auxiliary cover unit 300 may be coupled to positioning grooves not used for positioning the first supporting member 210. In such configuration, the auxiliary cover unit 300 can be used to cover an open area of the compartment 105 that is uncovered by the cover unit 200 in a sagged position as shown in FIG. 5.

Figure 5:
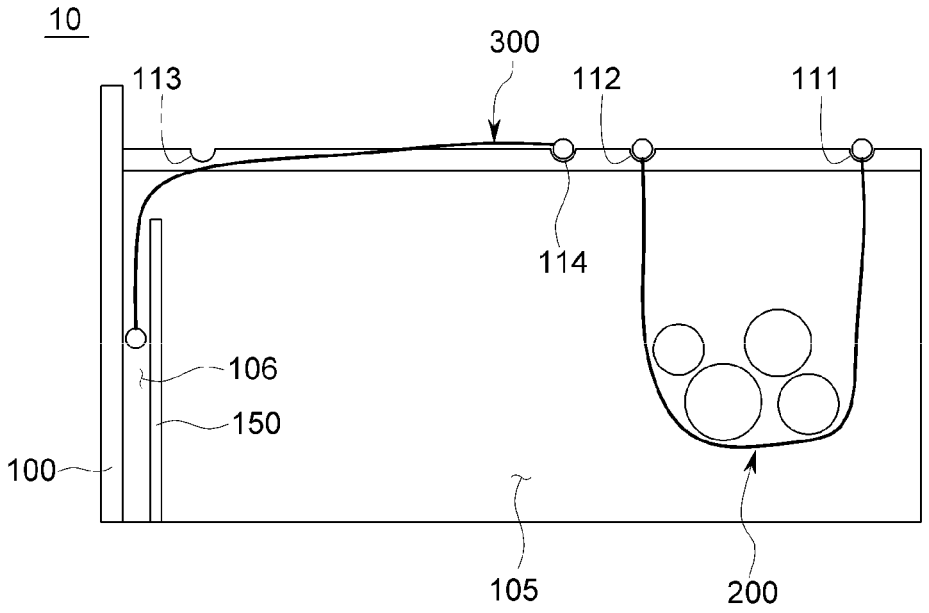

That is, the auxiliary cover unit 300 can effectively be used to cover the part of the top side uncovered by the cover unit 200 so as to effectively retain moisture of food stored in the compartment 105 as illustrated in FIG. 5.

The drawer assembly 10 according to the first embodiment of the present disclosure may further include an auxiliary cover accommodation chamber or slot 106 for accommodating a portion of the auxiliary cover unit 300. Particularly, the auxiliary cover accommodation chamber 106 may be formed between a partition wall 150 and a side wall of the drawer main body 100. The partition wall is disposed between two opposite side walls of the drawer main body 100.

The partition wall 150 may be lower than the side wall of the drawer main body 100 so that the auxiliary cover unit 300 may be easily inserted and removed therefrom.

Figure 6:
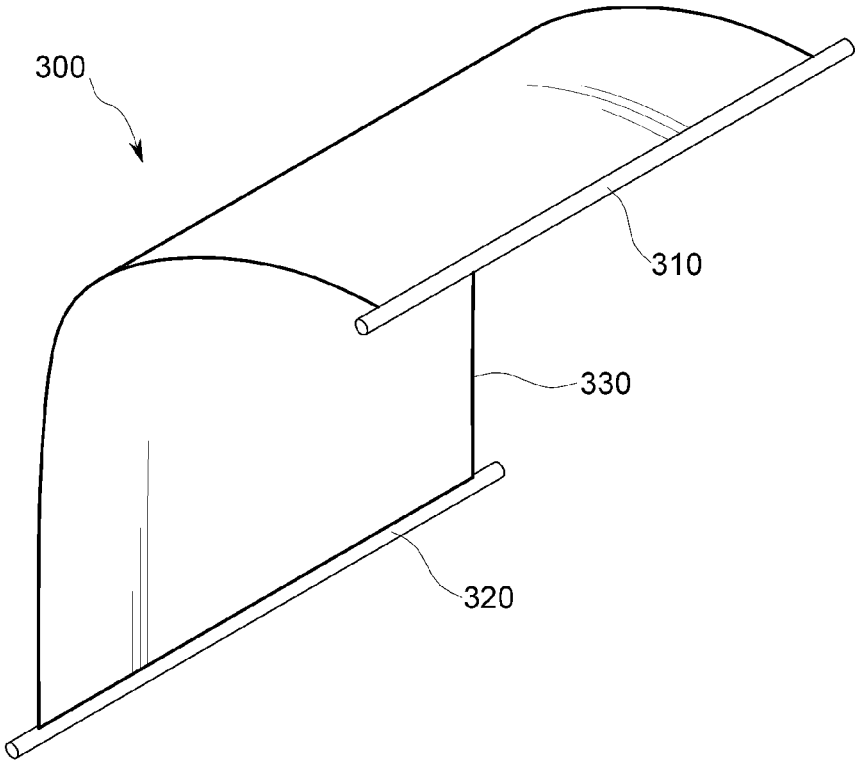
FIG. 6 is a diagram illustrating the configuration of an exemplary auxiliary cover unit.

As illustrated in FIG. 6, the auxiliary cover unit 300 according to the first exemplary embodiment of the present disclosure may include a first bar 310, a second auxiliary bar 320, and an auxiliary flexible sheet 330.

The first bar 310 can be positioned by the positioning grooves 111-113. Particularly, the first bar 310 may have the same configuration as the first rigid member 210, e.g., the shape and the size.

The second auxiliary bar 320 may have the same shape as the first auxiliary bar 310, but may be shorter than the first auxiliary bar 310 such that it can be placed inside the auxiliary cover accommodation chamber 106.

That is, the second auxiliary bar 320 may be accommodated in the auxiliary cover accommodation chamber 106 without being supported by the plurality or positioning grooves.

The second auxiliary bar 320 may be heavier than the first auxiliary bar 310 so it can be placed in the auxiliary cover accommodation chamber 106 securely. Additionally, the weight of the second auxiliary bar 320 applies a tension to the auxiliary flexible sheet 330 such that the auxiliary flexible sheet 330 can extend and cover an open area of the compartment 105.

When the first auxiliary rigid member 310 is released from the positioning grooves by a user, the first auxiliary bar 310 may automatically move to the auxiliary cover accommodation chamber 106 or the positioning groove 113 adjacent to the partition wall 150 under the pulling force applied by the second auxiliary bar 320.

Figure 8:
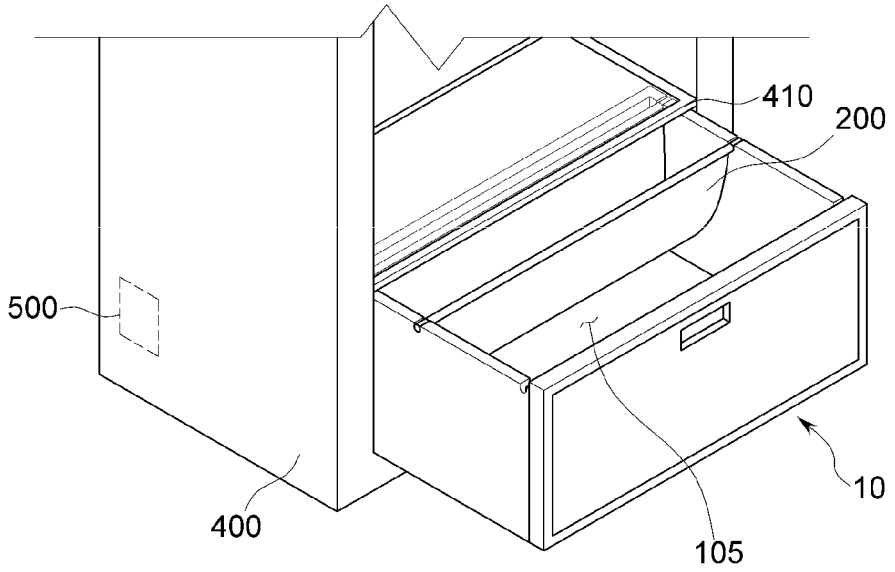
FIGS. 8 and 9 are diagrams illustrating an exemplary operation of a cover unit of the refrigerator including the drawer assembly of FIG. 7.

As illustrated in FIG. 8, according to embodiments of the present disclosure, the drawer assembly 10 may further include a main frame 400.

The main frame 400 may support the drawer main body 100 to be insertable and extractable.

The plurality of positioning grooves may include a first positioning groove 111, a second positioning groove 112, and a third positioning groove 113 as illustrated in FIG. 1 as described above.

The plurality of positioning grooves 111-113 may be arranged along the direction in which the drawer main body 100 is inserted into and extracted from the main frame of the refrigerator.

The first positioning groove 111 is spaced apart from the second positioning groove 112. Particularly, the first positioning groove 111 may be used to support the first rigid member 210.

The third positioning groove 113 may be closer to the front side of the drawer main body 100 than the second positioning groove 112. Particularly, the second positioning groove 112 may be located between the first positioning groove 111 and the third positioning groove 113.

Either the second positioning groove 112 or the third positioning groove 113 can be used to position the second rigid member 220.

For instance, when the cover unit 200 is used to divide the compartment 105, the first rigid member 210 may be inserted into the first positioning groove 111, and the second rigid member 220 may be inserted into the second positioning groove 112. Thus, the cover unit 200 is retained in position by the positioning grooves 111 and 112, and the flexible sheet member 230 may be used to support and store food items.

When the cover unit 200 is used to cover an open area of the compartment 105, the first rigid member 210 may be inserted into the first positioning groove 111, and the second rigid member 220 may be inserted into the third positioning groove 113. In this case, the sheet member 230 can effectively retain moisture of the food items stored in the compartment 105.

The plurality of positioning grooves 110 may further include a fourth positioning groove 114 as illustrated in FIG. 4 described above. The fourth positioning groove 114 may be used to support the first auxiliary rigid member 310 of the auxiliary cover unit 300. Particularly, the fourth positioning groove 114 may be formed between the third positioning groove 113 and the second positioning groove 112. The fourth positioning groove 114 may be located closer to the second positioning groove 112 than the third positioning groove 113.

For example, when the auxiliary cover unit 300 is placed in the auxiliary cover accommodation chamber 106, the third positioning groove 113 may be used to support the first auxiliary bar 310. In some embodiments, the first auxiliary bar 310 may also be placed in the auxiliary cover accommodation chamber 106.

When the auxiliary cover unit 300 is used to cover a portion of the top side of the compartment 105, the fourth positioning groove 114 may be used to position the first auxiliary bar 310 of the auxiliary cover unit 300.

The present disclosure is not limited by the number of positioning grooves disposed on the drawer main body 100. The number may be dependent on the length of the drawer main body 100.

With the aforementioned configuration, the drawer assembly 10 according to the first exemplary embodiment of the present disclosure may effectively preserve the freshness of food items stored in the drawer main body 100.

That is, the user may use the cover unit 200 to store soft food, or cover an open area of the compartment 105 to retain food moisture.

Figure 7:
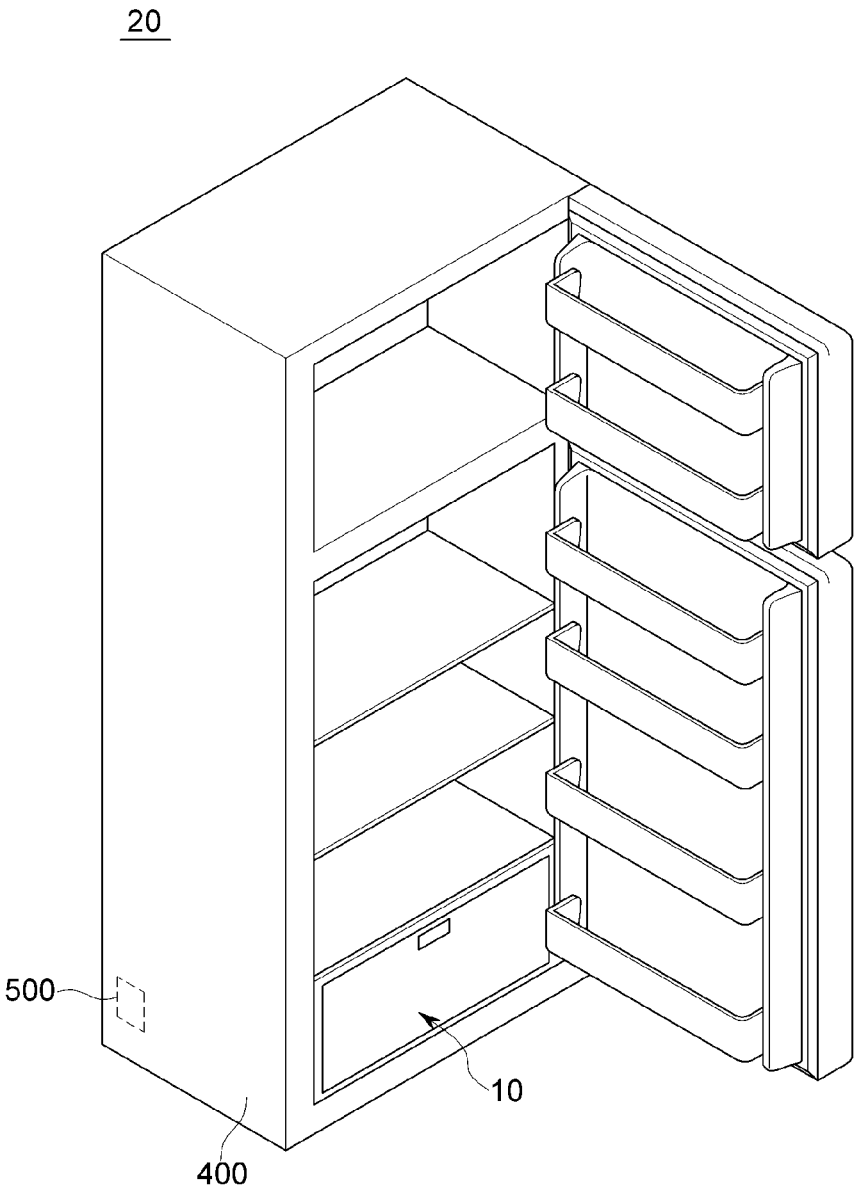
FIG. 7 is a diagram illustrating the configuration of an exemplary refrigerator according to a second embodiment of the present disclosure.

Hereinafter, a refrigerator 20 including an exemplary drawer assembly 10 according to a second exemplary embodiment of the present disclosure will be described with reference to FIG. 7 as well as FIGS. 1 to 6.

The refrigerator 20 includes the main frame 400, a cooling device 500, and the drawer assembly 10 which includes with the compartment 105, the plurality of positioning grooves 110, and the cover unit 200.

The plurality of positioning grooves include the first positioning groove 111, the second positioning groove 112, and the third positioning groove 113.

In one embodiment, the main frame 400 may be in a box-like shape. The cooling device 500 capable of refrigerating food is installed in the main frame 400.

A rack 410 for dividing the refrigerator space into separate storage regions is installed in the main frame 400 of the refrigerator 20.

That is, the drawer assembly 10 may be installed in one of the regions defined by the rack 410 in an insertable and extractable fashion. For example, the drawer assembly 10 may be used for storing vegetables.

The cover unit 200 may include the first rigid member 210 inserted into the first positioning groove 111, the second rigid member 220 selectively inserted into the second positioning groove 112 or the third positioning groove 113, and the sheet member 230.

That is, the cover unit 200 may be detachably supported by the plurality of positioning grooves 111-113.

The plurality of positioning grooves 111-113 of the refrigerator 20 may further include a fourth positioning groove 114 formed between the second positioning groove 112 and the third positioning groove 113. The refrigerator 20 may further include an auxiliary cover unit 300.

The auxiliary cover unit 300 may include the partition wall 150, the first auxiliary bar 310, the second auxiliary bar 320, and the auxiliary flexible sheet 330.

The partition wall 150 is positioned inside the drawer main body 100 and configured such that the first auxiliary bar 310, the auxiliary flexible sheet 330, and the second auxiliary bar 320 are accommodated and are insertable and extractable.

The auxiliary flexible sheet 330 may be made of a flexible material and connects the first auxiliary bar 310 with the second auxiliary bar 320.

Particularly, the second auxiliary bar 320 may be formed such that it is heavier than the first auxiliary bar 310.

Hereinafter, a method of using the refrigerator 20 according to a second exemplary embodiment of the present disclosure will be described with reference to FIGS. 8 and 9.

When a person wants to store food in the drawer assembly 10 installed in the refrigerator 20, the person draws out the drawer main body 100 from the main frame 400.

In this case, as illustrated in FIG. 8, when the user desires to store soft fruits and the like, the person divides the compartment 105 by placing them on the cover unit 200. In this case, soft fruit can be placed on the cover member 200 that is maintained in a sagged position. Other food items, such as hard vegetables, hard fruits, or the like, may be stored in the remaining region of the compartment 105, e.g., under the cover member 200.

Figure 9:
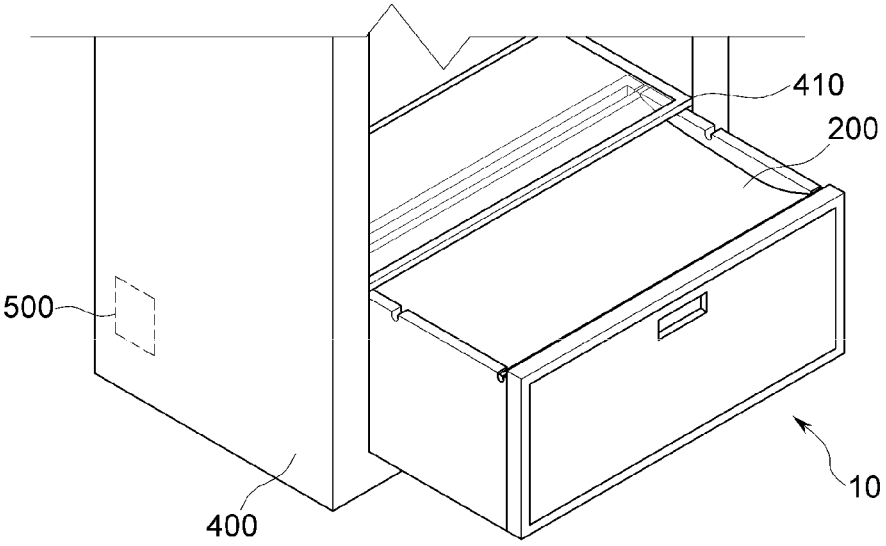

As illustrated in FIG. 9, the user can also use the cover unit 200 in the extended position to cover the top open side of the compartment 105, e.g., when food items can be stored in the compartment 105 without needing to be separated. In this case, the cover unit 200 can effectively retain moisture in the food items and prolong the freshness of food.

After the person places food in the drawer assembly 10, the person can push the drawer main body 100 back into the main frame 400.

With the aforementioned configuration, the refrigerator 20 according to the second exemplary embodiment of the present disclosure advantageously provides a convertible flexible sheet that can be conveniently used for storing soft food items or covering a storage drawer to prolong the freshness of food items stored therein. Particularly, a user may use the cover unit 200 to divide the compartment 105 into separate regions for soft food and hard food respectively. A person can also use the cover unit 200 to cover the open side of the compartment 105, thereby prolonging food freshness.

The exemplary embodiments of the present disclosure have been described with reference to the accompanying drawings, but those skilled in the art will understand that the present disclosure may be implemented in another specific form without changing the technical spirit or an essential feature thereof.

Accordingly, it should be understood that the aforementioned embodiments are illustrative in every aspect, and are not restrictive. The scope of the present disclosure is represented by the accompanying claims, and it should be construed that a meaning and a scope of the claim, and all changes or modified forms induced from an equivalent concept thereof are included in the scope of the present disclosure.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A drawer assembly for use within a refrigerator, said drawer assembly comprising:

a drawer unit having a bottom and four sides;

a plurality of pairs of aligned grooves disposed along tops of two opposing sides of said four sides, wherein two remaining sides of said four sides comprise a back side and a front side;

a first cover comprising a pair of first rigid rods with a first flexible sheet located therebetween, said first cover operable to be inserted within said drawer unit wherein said pair of first rigid rods are supported by two pairs of aligned grooves and wherein further said first flexible sheet sags to accommodate items placed therein; and a second cover comprising a pair of second rigid rods with a second flexible sheet located therebetween, said second cover operable to be inserted within said drawer unit wherein one second rigid rod is supported by a pair of aligned grooves and the other second rigid rod is heavier than said one second rigid rod and is inserted within a slot defined by a partition wall within said drawer unit and said front side of said drawer unit, said second cover for covering a top located space of said drawer unit that remains uncovered after insertion of said first cover.

2. The drawer assembly of claim 1, wherein said first cover is further operable to be supported by another two pairs of aligned grooves and extend to cover the top of the drawer unit.

* * * * *